US005590209A

United States Patent [19]

Pratt et al.

[11] Patent Number: 5,590,209

[45] Date of Patent: Dec. 31, 1996

[54] MOUNT FOR SUPPORTING A MICROPHONE ON A HELMET

[75] Inventors: David S. Pratt, San Jose; Philip Bourgeois, Woodside; Edward J. Cornelius, III, San Francisco; Chin H. Lee, Palo Alto; Blaise G. Stoltenberg, Oakland, all of Calif.

[73] Assignee: Setcom Corporation, Mountain View, Calif.

[21] Appl. No.: 279,282

[22] Filed: Jul. 22, 1994

[51] Int. Cl.[6] ..... H04R 25/00

[52] U.S. Cl. ..... 381/168; 381/183; 381/187; 455/100; 2/422; 2/906

[58] Field of Search ..... 381/169, 187, 381/183; 2/422, 906; 455/100

[56] References Cited

U.S. PATENT DOCUMENTS

| | | | |
|---|---|---|---|
| 3,586,977 | 6/1971 | Lustig et al. | 381/169 |
| 3,786,519 | 1/1974 | Aileo | 381/187 |
| 4,788,724 | 12/1988 | Lazzeroni et al. | 381/187 |
| 4,917,504 | 4/1990 | Scott et al. | 381/169 |

*Primary Examiner*—Curtis Kuntz
*Assistant Examiner*—Duc Nguyen
*Attorney, Agent, or Firm*—Flehr, Hohbach, Test, Albritton & Herbert

[57] ABSTRACT

A mount for supporting a microphone on a helmet having an outer shell and for use with a transmission cable. The microphone is mounted on a flexible boom carrying leads connected to the microphone. The transmission cable carries electrical conductors. The mount includes an attachment assembly having a surface with a contour which conforms to the outer shell of the helmet. The attachment assembly is provided with a sleeve-like member adapted to receive the flexible boom and a retainer for receiving the transmission cable. Connectors are carried within the attachment assembly for electrically connecting the electrical conductors from the transmission cable to the leads to the microphone. A layer of an adhesive material is carried by the surface of the attachment assembly and is adapted to fasten the attachment assembly to the outer shell of the helmet. The layer of adhesive material permits the fastening of the attachment assembly to the helmet without impairing the structural integrity of the helmet.

21 Claims, 3 Drawing Sheets

MOUNT FOR SUPPORTING A MICROPHONE ON A HELMET

BRIEF DESCRIPTION OF THE INVENTION

This invention relates to communications accessories for helmets and more particularly to mounts for supporting microphones on helmets.

BACKGROUND OF THE INVENTION

Mounts for supporting microphones on helmets such as motorcycle helmets have been provided. Many of these mounts are derivatives of microphone supports developed for military helmets decades ago. In general, these mounts suffer from a number of disadvantages. Most of these mounts cannot be secured to a helmet without creating holes in the helmet. These attachment holes can structurally weaken a helmet. Other mounts can be attached to a helmet without the need of holes in the helmet, but can be inadvertently or accidently detached from the helmet. Many of the available mounts are not of an aerodynamic design and, as such, create deleterious wind noise which interferes with communications when used on a motorcycle helmet. The boom structures on some mounts are formed with inflexible wire which can pierce the skin of the user if broken. In addition, some of the currently available mounts do not permit the ready replacement of components. A significant number of the available mounts do not protect the leads extending to speakers inside the helmet from damage or fraying.

OBJECTS AND SUMMARY OF THE INVENTION

The primary object of the present invention is to provide a mount for supporting a microphone on a helmet which can be fastened to the helmet without affecting the structural integrity of the helmet.

Another object of the invention is to provide a mount of the above character which has an aerodynamic profile so as to minimize wind noise during use.

Another object of the invention is to provide a mount of the above character in which the electrical connections between the microphone, speakers and transmission cable are protected from the elements within the mount.

Another object of the invention is to provide a mount of the above character in which the microphone, speakers and transmission cable connected to the mount can be easily replaced if necessary.

Another object of the invention is to provide a mount of the above character which includes a shield for protecting the leads extending around the rim of the helmet from fraying or other damage.

Another object of the invention is to provide a mount of the above character which can accommodate a flexible boom for supporting the microphone.

These and other objects are achieved by a mount for supporting a microphone on a helmet having an outer shell and for use with a transmission cable. The microphone is mounted on a flexible boom carrying leads connected to the microphone. The transmission cable carries electrical conductors. The mount includes an attachment assembly having a surface with a contour which conforms to the outer shell of the helmet. The attachment assembly is provided with a sleeve-like member adapted to receive the flexible boom and means adapted for receiving the transmission cable. Connectors are carried within the attachment assembly for electrically connecting the electrical conductors from the transmission cable to the leads to the microphone. A layer of an adhesive material is carried by the surface of the attachment assembly and is adapted to fasten the attachment assembly to the outer shell of the helmet. The layer of adhesive material permits the fastening of the attachment assembly to the helmet without impairing the structural integrity of the helmet.

Additional objects and features of the invention will appear from the following description from which the preferred embodiment is set forth in detail in conjunction with the accompanying drawings.

DETAILED DESCRIPTION OF THE INVENTION

Reference will now be made in detail to the preferred embodiment of the invention which is illustrated in the accompanying figures. The description of the embodiment of the invention will be followed by a discussion of its operation.

Figure 1:
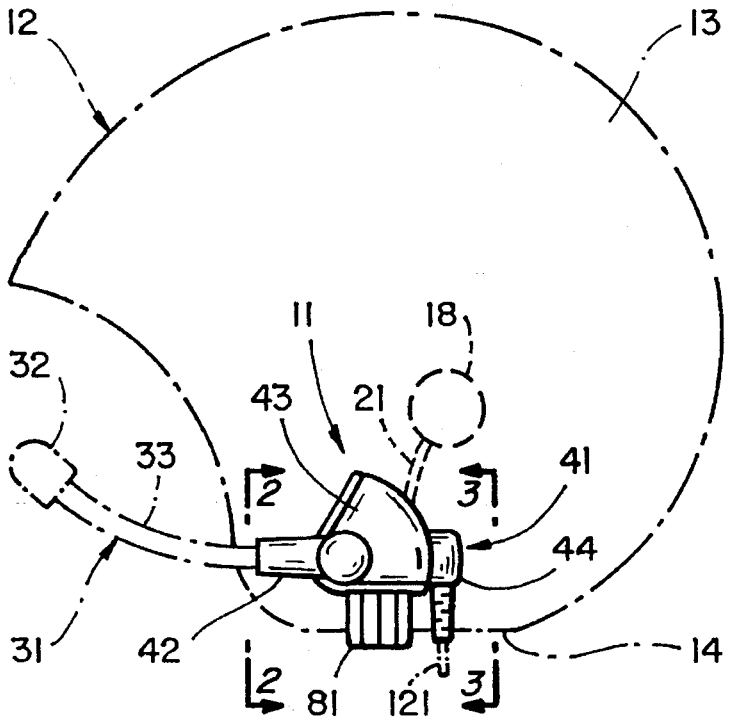
FIG. 1 is a side elevational view of the microphone mount of the present invention attached to a motorcycle helmet.
Figure 2:
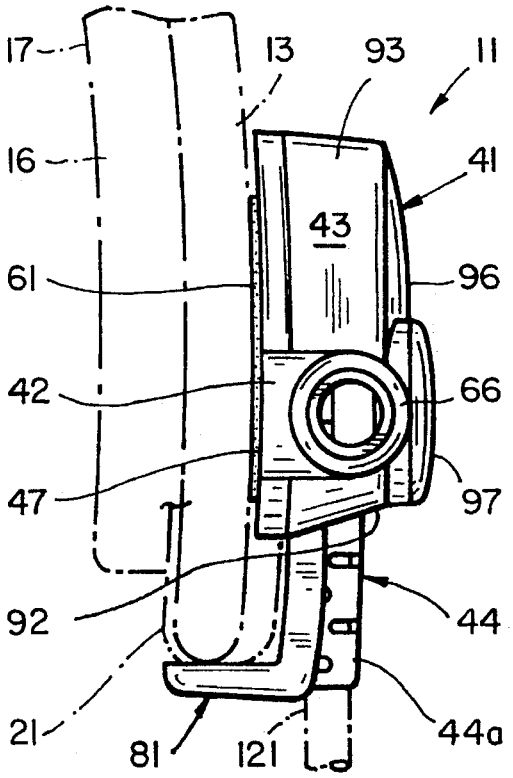
FIG. 2 is front elevational view of the microphone mount of FIG. 1 taken along the line 2—2 of FIG. 1.
Figure 3:
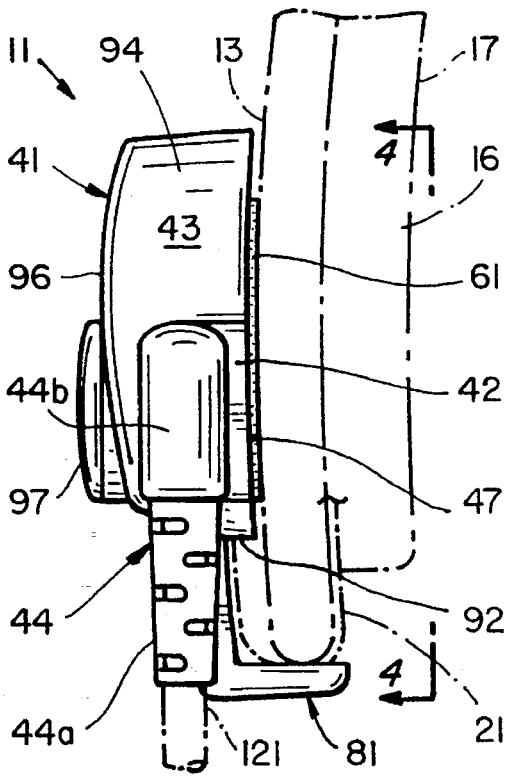
FIG. 3 is rear elevational view of the microphone mount of FIG. 1 taken along the line 3—3 of FIG. 1.

Microphone support or mount 11 of the present invention is for use with a helmet such as a motorcycle helmet 12 having an outer shell 13 with a lower peripheral rim 14 (see FIGS. 1 through 3). Spherical shell 13 has external compound curves and may or may not, particularly near peripheral rim 14, be of uniform thickness. The helmet has internal padding 16 defining an internal cavity 17. First or left and second or right earphones or speakers 18 are mounted in padding 16 in positions proximate to the ears of a human using the helmet. An electrical wire 21 is connected to each of speakers 18 and includes leads 22 having lugs 23 mounted on the ends thereof. Mount 11 is adapted for use with a microphone and boom assembly 31, such as that made by Lectret, SA of Geneva, Switzerland, which includes a noise cancelling microphone 32 using an amplified electret element mounted on the distal end of a flexible tubular element or boom 33. Leads 36 are electrically connected to microphone 32 and extend through flexible boom 33 for transmission of the electrical signals detected by the microphone. Leads 36 have lugs 37 mounted on the ends thereof.

Figure 4:
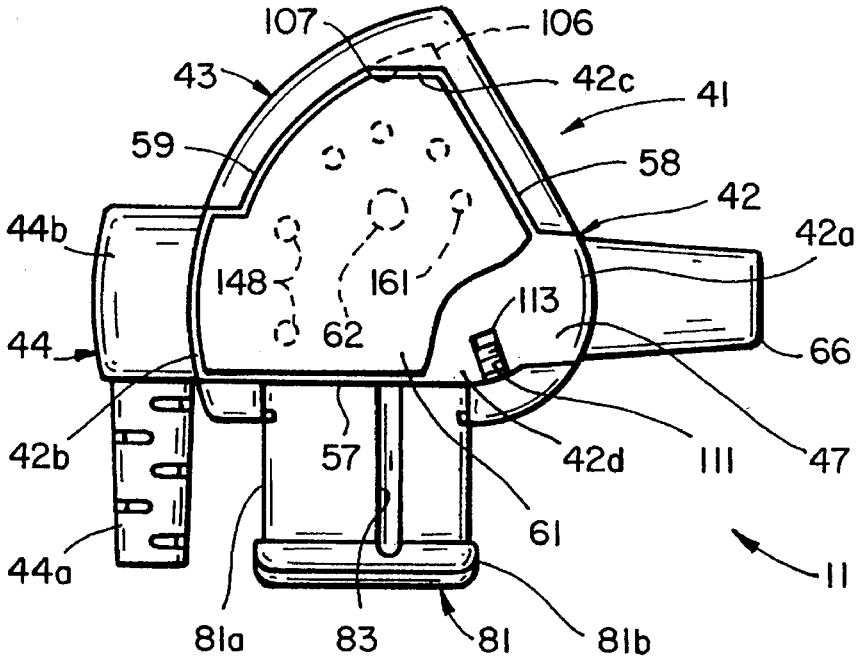
FIG. 4 a side elevational view of the microphone mount of FIG. 1, without inclusion of the helmet, microphone or cable, taken along the line 4—4 of FIG. 3.
Figure 5:
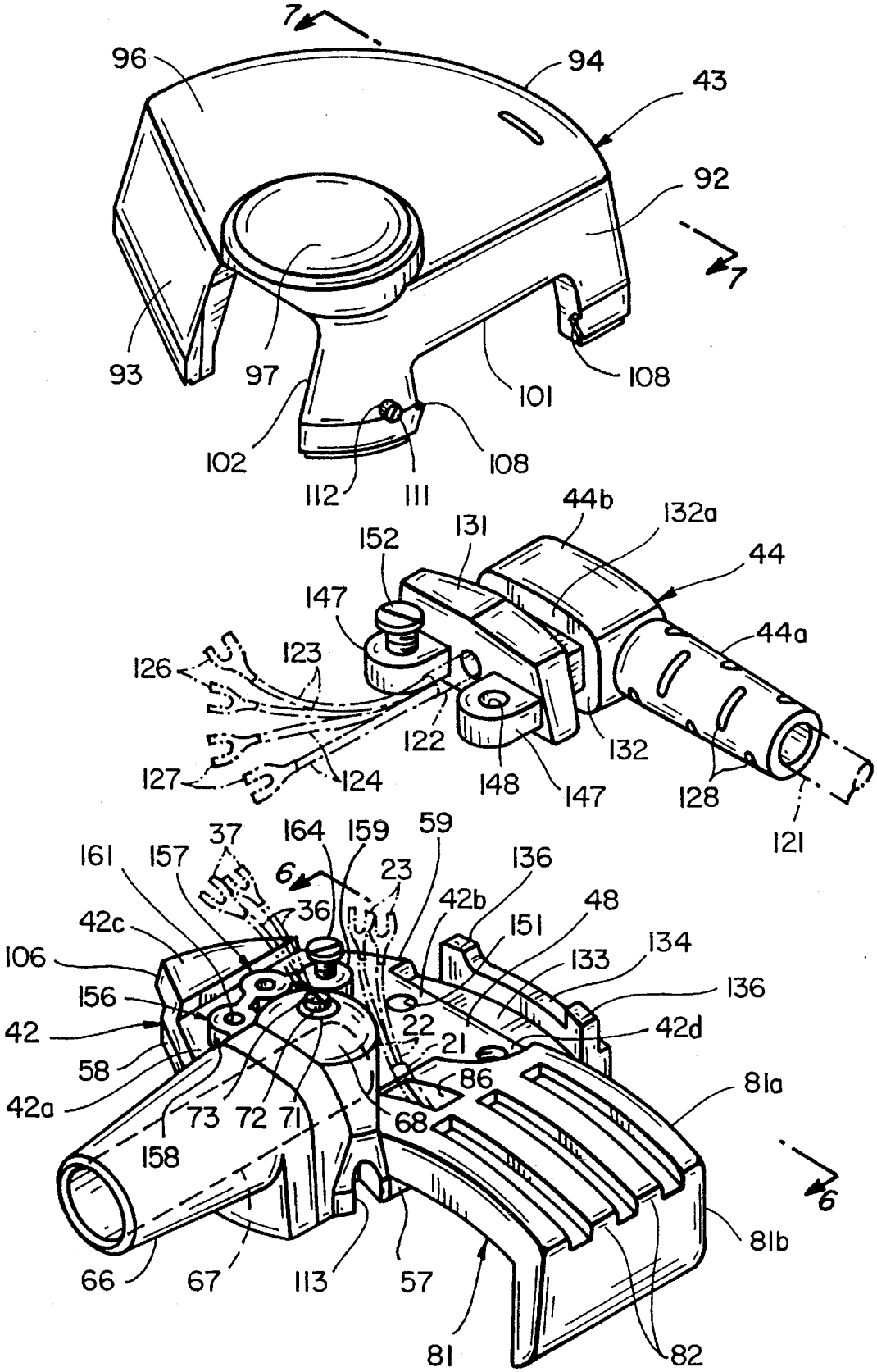
FIG. 5 is an exploded isometric view of the microphone mount of FIG. 1.

Microphone mount 11 consists of an attachment assembly 41 formed from an attachment or base plate 42, a cover 43 and a cord set or retainer 44 (see FIG. 5). Base plate 42 is made from any suitable material such as a plastic sold under the trademark "Xenoy" by General Electric Plastics and has opposite front and rear portions **42*a* and 42*b* and opposite top and bottom portions 42***c* and 42*d*. The base plate includes opposite first or inner and second or outer surfaces 47 and 48. Spherically concave inner surface 47 has a contour which generally conforms to the shape of helmet shell 13 and, in this regard, extends arcuately inwardly between front and rear portions 42*a* and 42*b* and, as illustrated in FIGS. 2 and 3, between top and bottom portions 42*c* and 42*d*. When viewed in side elevational plan, as shown in FIG. 4, the base plate is generally pie-shaped, being formed with a bottom side 57 extending in a generally horizontal direction, a front side 58 extending rearwardly from bottom side 57 at an oblique angle to the bottom side and an arcuately-extending rear side 59 extending between the bottom and front sides.

Base plate 42 is adapted to fasten attachment assembly 41 to the outside of helmet shell 13 and includes means in the form of a layer 61 of a double-sided adhesive material carried by inner surface 47 for securely fastening the base plate to helmet 12 (see FIGS. 2 and 3). Adhesive layer 61 can be made from any suitable material such as "Scotch" brand "VHB" (Very High Bond) 4929 Tape made by 3M of St. Paul, Minn. A hole 62, as shown in FIG. 4, extends between inner and outer surfaces 47 and 48 of base plate 42 and permits a screw (not shown) to extend therethrough and serve as an additional or alternate means of fastening attachment assembly 41 to helmet 12.

Base plate 42 is adapted for receiving flexible boom 33 and, as illustrated in FIG. 5, is formed with a tubular sleeve-like member or sleeve 66 extending forwardly from bottom and front sides 57 and 58 in a direction generally parallel to the bottom side. Sleeve 66 tapers inwardly as it extends forwardly so as to generally have the shape of a truncated cone. Sleeve 66 is included within the means of attachment assembly 41 for removably mounting flexible boom 33 to the attachment assembly and is provided with a bore 67 which extends longitudinally through the sleeve and is cross-sectionally sized and shaped so as to accommodate the end of the flexible boom. The rear portion of sleeve 66 is formed with a boss 68 on the top thereof Which is semi-spherical or mound-like in shape and is provided with a bore 71 extending through the center thereof into bore 67 at a right angle. Means is carried by sleeve 66 for securing the flexible boom within bore 67 and includes an internally threaded insert 72 made from any suitable material such as brass which is ultrasonically bonded or otherwise suitably secured within bore 71. A threaded member or set screw 73 is threadedly carried by insert 72 and when tightened extends into bore 67 to engage the side of the flexible boom.

Figure 6:
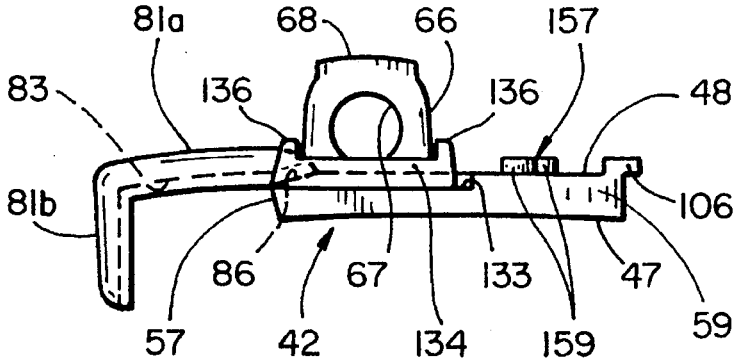
FIG. 6 is a side elevational view taken along the line 6—6 of FIG. 5.

A grooved guard or shield 81 is secured to attachment assembly 41 for protecting the portion of speaker wire 21 exposed outside of helmet 12 as shown in FIGS. 2 and 3. Projection or shield 81 is formed integral with base plate 42 and has an arcuate or dome portion in the form of extension 81*a* which extends downwardly from bottom portion 42*d* of the base plate and a lip portion or lip 81*b* which extends inwardly at approximately a right angle to extension 81*a* (see FIG. 5). The shield extends generally rearwardly from sleeve 66 along bottom portion 42*d*. Extension 81*a* is formed with a plurality of four spaced-apart reinforcement ribs 82 extending downwardly along the outside thereof. As illustrated in FIGS. 5 and 6, a groove 83 is formed along the inside of shield 81 and extends downwardly along extension 81*a* and inwardly along lip 81*b* and a passageway or hole 86 is provided through extension 81*a* of the shield from outer surface 48 of base plate 42 into groove 83.

Figure 7:
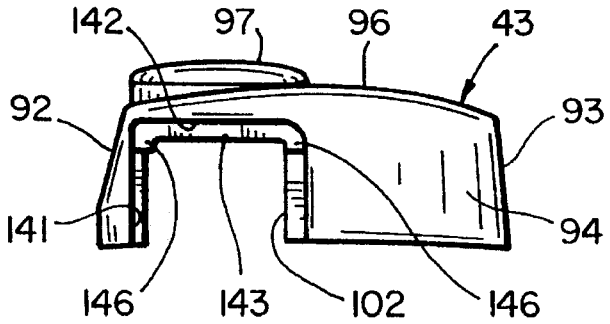
FIG. 7 is a side elevational view taken along the line 7—7 of FIG. 5.

Cover 43, shown separately in FIGS. 5 and 7, is removably mountable to base plate 42 and is made from any suitable material such as a plastic sold under the trademark "Xenoy". When viewed in side elevational plan, as seen in FIG. 1, cover 43 has a shape which generally conforms to the shape of base plate 42 and defines the shape of attachment assembly 41. More particularly, cover 43 is generally pie-shaped and has a bottom side 92 which extends in a generally horizontal direction, a front side 93 which extends upwardly and rearwardly from bottom side 92 at an oblique angle and a rear side 94 which extends arcuately between bottom and front sides 92 and 93. The cover is sized so that sides 92, 93 and 94 extend outwardly along sides 51, 58 and 59 of base plate 42 to a top side or ceiling 96 provided with a dome 97 at the front of the cover for receiving boss 68 of the base plate. Bottom and front sides 92 and 93 of the cover are formed with respective openings 101 and 102 therein through which shield 81 and sleeve 66 respectively extend. Bottom and front sides 92 and 93 taper inwardly as they extend upwardly to ceiling 96 which, in turn, tapers outwardly from dome 97 to arcuate rear side 94.

Means is carried by cover 43 and base plate 42 for securing and locking the cover to the base plate and includes a hook-like extension or hook 106 which extends outwardly and then upwardly from outer surface 48 of the base plate at top portion 42*c* and a lip 107 which extends between front and rear sides 93 and 94 along the inside of cover 43 (see FIGS. 4–6). The securing means of cover and base plate 43 and 42 further includes two opposed protuberances or hooks 108 which extend inwardly from each other at the inside of opening 101 in the cover. Hooks 108 are formed to slide past shield 81 as cover 43 is mounted to base plate 42 and then extend inwardly along the inside of the shield so as to secure the cover to the base plate. The means for locking cover 43 to base plate 42 includes a set screw 111 which extends through a bore 112 in bottom side 92 of the cover to seat in a recess 113 formed in bottom side 57 of the base plate adjacent the rear of sleeve 66.

Attachment assembly 41 has means, which includes retainer 44 illustrated in FIG. 5, adapted for receiving a transmission cable 121 having an end 122 and carrying at least first electrical conductors in the form of first wires 123 for attachment to leads 36 of microphone 32 and second wires 124 for attachment to leads 22 of speakers 18. Wires 123 and 124 have lugs 126 and 127 mounted on the respective ends thereof. Retainer 44 is generally L-shaped and made from any suitable material such as a relatively flexible and soft polyvinyl chloride or polyurethane material. The retainer is mounted about cable end 122 by being molded thereabout and includes a sleeve portion 44*a* and a coupling portion 44*b*. Sleeve portion 44*a*, which can be more flexible than coupling portion 44*b*, is generally tubular in shape and tapers slightly as it extends downwardly along the length of transmission cable 121. A plurality of circumferentially spaced-apart strain relief slots 128 extend through the sleeve portion to the transmission cable therein and are provided along the length of the sleeve portion. However, it should be appreciated that sleeve portion 44*a* can be formed without strain relief slots 128 and be within the scope of the present invention.

Cooperative means is carried by coupling portion 44*b* of retainer 44, base plate 42 and cover 43 for removably mounting the retainer to the base plate and captivating the retainer between the base plate and the cover (see FIGS. 3 and 5–7). This cooperative means includes an enlarged flange 131 formed at the end of coupling portion 44*b* and extending in a direction generally parallel to sleeve portion 44*a* of the retainer. A groove 132 extends around coupling portion 44B behind flange 131 and includes opposite slots 132*a* which extend generally in the longitudinal direction of retainer 44 on opposite sides of coupling portion 44*a*. Base plate 42 is formed with a slot or groove 133 extending adjacent a portion of rear side 59 and a lip or ridge 134 extending between groove 133 and rear side 59. Groove and ridge 133 and 134 are sized and shaped to cooperatively meet with flange 131 and one of slots 132*a*, respectively, of coupling portion 44*b* of the retainer. Ridge 134 is provided with extensions 136 extending outwardly along each end of the ridge for extending partially around groove 132 of the retainer so as to position the retainer on the base plate. Cover 43 is formed with an opening 141 in rear side 94 which is sized for extending around coupling portion 44*b* of retainer 44. A recess 142 is formed in the cover at the top of opening 141 so as to form a lip or ridge 143 which extends into one of slots 132*a* of groove 132. Ridge 143 is formed with extensions 146 which extend inwardly at each end of the ridge and serve to extend around groove 132 in coupling portion 44*b* and engage extensions 136 extending outwardly from base plate 142.

Means is carried by retainer 44 and base plate 42 for securing the retainer to the base plate and includes two adjacent tabs 147 which extend from flange 131 of the retainer and are provided with holes 148 extending therethrough. First and second holes 151 extend between outer and inner surfaces 48 and 47 of base plate 42. Thread forming screws 152, one of which is shown in FIG. 5, extend through holes 148 in tabs 147 into holes 151 to secure retainer 44 to base plate 42.

Connectors are carried by attachment assembly 41 for electrically connecting the wires of transmission cable 121 to the leads of speakers 18 and microphone 32. More specifically, base plate 42 has first and second sets of connectors 156 and 157 which include first and second sets of posts formed integral with base plate 42 and extending outwardly from outer surface 48 of the base plate (see FIGS. 5 and 6). Each of the posts is formed with a bore 161. Each of the connectors further includes a thread forming screw 164, one of which is shown in FIG. 5, for threading into the respective bore 161 and securing together the appropriate lugs from leads 22 and 36 and wires 123 and 124. Although certain of the connectors shown in FIG. 5 have been identified as first or second sets of connectors 156 and 157, it should be appreciated that the specific connectors utilized as first or second connectors can be changed and be within the scope of the present invention.

In assembling mount 11 of the present invention, retainer 44 is mounted to base plate 42 by placing flange 131 of the retainer in groove 133 formed in the base plate and ridge 134 of the base plate is seated within groove 132 of the retainer. Screws 152 are inserted through holes 148 in tabs 147 and secured within holes 151 to secure the retainer to the base plate. Retainer 44 has a configuration for carrying the wires of transmission cable 121 into attachment assembly 41. More specifically, wires 123 and 124 extend generally perpendicularly from flange 131 in a forward direction and at a right angle to sleeve portion 44*a* of the retainer so that the wires are available for use at first and second sets of connectors 156 and 157.

Microphone and boom assembly 131 is easily mounted to attachment assembly 41 by inserting leads 36 carried by flexible boom 33 through bore 67 of sleeve 66 and then sliding flexible boom 33 into the sleeve until disposed in a desired position. The tightening of set screw 73 serves to secure flexible boom 33 within sleeve bore 67. Lugs 37 on first leads 36 from microphone 32 are electrically connected to lugs 126 on first wires 123 from transmission cable 121 by first connectors 61. As can be appreciated by those skilled in the art, respective lugs can be mounted about the appropriate connector and secured together by the fastening of the corresponding screw 164. In this manner, the pressure from the screw forms a solid electrical connection between the leads and wires.

Electrical wire 21 from speakers 18 is threaded through hole 86 in shield 81 so that second or additional leads 22 from the speakers can be electrically connected in the manner discussed above to second or additional wires 124 of the transmission cable by second or additional connectors 157. Cover 43 is thereafter mounted and secured to base plate 42 with relatively concealed set screw 111 in the manner discussed above.

As assembled, attachment assembly 41 has a height, defined by the distance between bottom side 92 and the top of front side 93 of cover 43, equal to approximately 1 and ½ inch and a length, defined by the distance between the bottom of front and rear sides 93 and 94 of the cover, equal to approximately 1 and ⅝ inch. Shield 81 extends downwardly from bottomside 92 of cover 43 approximately ¾ inch and has a width of approximately 13/16 inch. The shield has a thickness of approximately ⅛". Lip 81*b* extends inwardly approximately ⅜" from extension 81*a* and has a thickness of approximately ⅛" at extension 81*a* before tapering slightly as it extends inwardly.

Mount 11, as illustrated and described, is intended to be attached to the outside of helmet 12 along the base thereof. When the attachment assembly is positioned in this manner, extension 81*a* of shield 81 extends from base plate 42 to rim 14 and lip 81*b* of the shield extends at least partially around rim 14. As shown in FIGS. 2 and 3, lip 81*b* extends at least half of the way around the rim of the helmet. Groove 83 formed on the inside of shield 81 permits the portion of electrical wire 21 on the outside of helmet 12 to be covered by the shield and protected from harm and damage.

Adhesive layer 61 permits mount 11 to be fastened to the outside of helmet 12 without impairing the structural integrity of the helmet. In this regard, once attachment assembly 41 has been properly positioned on helmet shell 13, base plate 42 is firmly pressed against shell 13 so that adhesive layer 61 sandwiched between the base plate and the shell can form a firm bond therebetween. Weak points in shell 13 are avoided by not having to drill holes therein so as to secure mount 11 to the helmet. Furthermore, the firm bond created by adhesive layer 61 precludes mount 11 and microphone and boom assembly 31 carried thereby from being easily knocked off or removed from the helmet during use.

Mount 11 is aesthetically pleasing and has an aerodynamic design which reduces undesirable wind noise which can interfere with communications to and from the user of helmet 12. As illustrated in FIG. 2 and more generally in FIGS. 1 and 3, attachment assembly 41 has a front profile which is free of projections for minimizing such wind noise. Retainer 44 is mounted to the rear of base plate 42 so that transmission cable 121 carried by the retainer enters mount 11 from the rear as opposed to the side of the mount. Retainer 44 is configured so that sleeve portion 44*a* is disposed behind shield 81 for further enhancing the aerodynamic design of mount 11. Sleeve 66 extends in a forward direction for minimizing its frontal profile and has a conical configuration for further minimizing wind resistance. Cover 43 has a relatively smooth outer surface and is formed with a generally horizontally disposed bottom side 92 and a rearwardly inclined front side 93 for minimizing its frontal profile and promoting non-turbulent air flow around mount 11. Cover 43 extends around base plate 40 to so as to generally engage helmet shell 13, as illustrated in FIGS. 2 and 3, and thus serves to limit mating surfaces between the cover and the base plate which can be exposed to the air and possibly produce whistling or other noises during use of mount 11.

Mount 11 facilitates quick and easy repairs using only common hand tools. Once attachment assembly 41 has been mounted to a helmet 12 for use in the manner discussed above, cover 43 can be easily removed by loosening set screw 111 and pulling the bottom of the cover outwardly from shield 81 and then upwardly off hook 106. Electrical connections between the wires of transmission cable 121 and the leads to speakers 18 and microphone 32 can be easily disconnected by loosening screws 164. Microphone and boom assembly 31 can then be removed for replacement by merely loosening set screw 73 and retainer 44 can be easily removed for replacement by removing screws 152. Should speakers 18 be in need of repair or replacement, electrical wire 21 can be easily pulled through groove 83 and hole 86 and the wire from new speakers threaded through the groove and hole to connectors 157 carried by the base plate. The ability to easily and quickly repair various components of attachment assembly 41 increases the operating efficiency and life of mount 11.

All electrical connections at mount 11 are inside of attachment assembly 41 and protected from the elements by cover 43 which, as discussed above, fits snugly up against the outside of helmet shell 13 so as to enclose connectors 156 and 157 carried by base plate 42. As such, attachment assembly serves to limit corrosion or other deposits from forming at the point of electrical connections. Such corrosion is particularly suspectable in humid climates and can hinder the transmission of electrical signals through the connections.

Mount 11 is particularly suited for use by motorcycle police officers. Microphone 32 permits good communications with the officer by cancelling out undesirable background noise even when the officer is travelling at high speeds. The sleek design of mount 11 reduces undesirable wind noise when the officer is travelling at these high speeds. The mount can be easily repaired by the officer when necessary and the ability to replace damaged or inoperable components extends the life of the mount. Shield 81 protects wire 21 to speakers 18 during use and storage of helmet 12 and thus serves to decrease the: likelihood of transmission problems in the field.

From the foregoing, it can be seen that a mount for supporting a microphone on a helmet has been provided which can be fastened to the helmet without affecting the structural integrity of the helmet. The mount has an aerodynamic profile so as to minimize wind noise during use and permits the microphone, speakers and transmission cable connected to the mount to be easily replaced if necessary. The electrical connections between the microphone, speakers and transmission cable are protected from the elements within the mount. The mount includes a shield for protecting the leads extending around the rim of the helmet from fraying or other damage and can accommodate a flexible boom for supporting a microphone.

What is claimed is:

1. A microphone mount assembly for use with a motorcycle helmet having a hardened outer shell and with a transmission cable carrying electrical conductors, comprising a mount having a front and rear and a front profile which includes opposite inner and outer surfaces, the inner surface having a contour which conforms to the outer shell of the helmet prior to being mounted on said helmet and the outer surface being generally smooth and free of projections, a cylindrical boom member having first and second end portions, a microphone mounted on the first end portion of the boom member, a sleeve-like member extending from the front of the mount in a forward direction within the front profile for receiving the second end portion of the boom member and directing the boom member forwardly so that the microphone is disposed in front of the helmet, receiving means extending from the rear of the mount adapted for receiving the transmission cable and means adapted to secure the mount to the helmet consisting of a layer of an adhesive material carried by the inner surface for fastening the mount to the outer shell of the helmet whereby the layer of adhesive material permits the fastening of the mount to the helmet without impairing the structural integrity of the helmet and whereby the generally smooth outer surface, the sleeve-like member extending from the front of the mount within the front profile and the receiving means extending from the rear of the mount minimize undesirable wind noise during use of the microphone mount assembly on a helmet.

2. The assembly of claim 1 for use with a transmission cable having an end wherein the receiving means includes a retainer adapted for mounting about the end of the transmission cable.

3. The assembly of claim 2 wherein the sleeve-like member and the retainer extend in generally opposite directions.

4. The assembly of claim 2 wherein the retainer has a configuration for carrying the electrical conductors into the mount.

5. The assembly of claim 2 wherein the mount includes a base plate for attachment to the outer shell of the helmet and cooperative means carried by the base plate and the retainer for removably mounting the retainer to the base plate.

6. The assembly of claim 5 wherein the cooperative means includes a ridge provided in one of the base plate and the retainer which extends transversely of the end of the transmission cable and a slot for receiving the ridge carried by the other of the base plate and the retainer.

7. The assembly of claim 5 further comprising lead means electrically coupled to the microphone and carried within the boom member and connectors carried by the base plate and including at least one screw for creating electrical connections between the electrical conductors from the transmission cable and the lead means from the microphone.

8. The assembly of claim 2 wherein the retainer is made from a flexible material which is molded about the end of the transmission cable.

9. The assembly of claim 1 further comprising lead means electrically coupled to the microphone and carried within the boom member and connectors carried within the mount for creating electrical connections between the electrical conductors from the transmission cable and the lead means from the microphone.

10. The assembly of claim 9 further comprising a threaded member carried by the sleeve-like member for engaging the boom member, the threaded member being included within means for removably mounting the boom member to the mount.

11. The assembly of claim 1 together with connectors carried within the mount for electrically coupling the microphone to the electrical conductors, the mount including a base plate having the inner surface with a contour which conforms to the shape of the outer shell of the helmet and a cover mountable on the base plate for enclosing the connectors.

12. The assembly of claim 11 wherein the cover extends to the inner surface so as to generally enclose the base plate.

13. The assembly of claim 1 wherein the mount is free of wires extending away from the mount exterior of the helmet exclusive of the transmission cable.

14. The assembly of claim 1 wherein the mount has front and bottom surfaces which extend rearwardly from the sleeve-like member.

15. The assembly of claim 1 for use with a helmet having a rim and with lead means extending to speakers mounted inside the helmet, a shield secured to the mount for carrying the lead means and extending at least partially around the rim of the helmet for protecting the lead means from damage.

16. The assembly of claim 15 wherein the mount includes a base plate having the inner surface with a contour which conforms to the shape of the outer shell of the helmet and wherein the shield extends downwardly from the base plate.

17. A communications assembly for use with a motorcycle helmet having a hardened outer shell and a rim, comprising a mount having an inner surface with a contour which conforms to the outer shell of the helmet prior to being mounted on said helmet, means adapted for fastening the inner surface of the mount to the outer shell of the helmet above the rim, a transmission cable having an end, means for coupling the end of the transmission cable to the mount, an elongate flexible boom having a first end portion carrying a microphone and an opposite second end portion, means for attaching the second end portion of the flexible boom to the mount, first and second speakers, electrical lead means coupled to the speakers and having a portion extending exterior of the helmet to the mount and a shield depending from the mount and extending along the exterior of the shell over said portion of the lead means and at least partially around the rim of the helmet, the shield serving as means for protecting said portion of the lead means from harm and damage.

18. The assembly of claim 17 wherein the mount has a profile from the front which is free of projections for minimizing wind noise during use of the communications assembly on the helmet.

19. The assembly of claim 17 wherein the means for fastening the mount to the outer shell of the helmet includes a layer of an adhesive material carried by the inner surface of the mount.

20. A communications assembly for use with a motorcycle helmet having a hardened outer shell and a rim, comprising a mount having a front and rear and having a base plate and a cover removably mountable to the base plate, the base plate having an inner surface with a contour which conforms to the outer shell of the motorcycle helmet prior to being mounted on said helmet, a layer of an adhesive material carried by the inner surface of the base plate adapted to fasten the mount generally flush to the outer shell of the motorcycle helmet above the rim, a cylindrical boom member having a first end portion carrying a microphone and an opposite second end portion, means for removably attaching the second end portion of the boom member to the front of the mount, a transmission cable, means for removably attaching the transmission cable to the rear of the mount, first and second speakers adapted for mounting interior of the helmet, lead means electrically coupled to the speakers and having a portion extending exterior of the helmet, means for removably coupling the lead means to the mount and a shield attached to the mount and extending downwardly alongside the outer shell and below the rim of the helmet and covering said portion of the lead means extending exterior of the helmet, the mount having a profile which is free of projections for minimizing wind noise during use of the communications assembly on the helmet.

21. The assembly of claim 17 wherein shield extends below the rim of helmet.

* * * * *